US006857632B2

(12) United States Patent
Tanner

(10) Patent No.: US 6,857,632 B2
(45) Date of Patent: Feb. 22, 2005

(54) PUZZLES

(76) Inventor: Terry Lee Tanner, P.O. Box 150771, Austin, TX (US) 78715-0771

( * ) Notice: Subject to any disclaimer, the term of this patent is extended or adjusted under 35 U.S.C. 154(b) by 0 days.

(21) Appl. No.: 10/266,013

(22) Filed: Oct. 7, 2002

(65) Prior Publication Data

US 2004/0065997 A1 Apr. 8, 2004

(51) Int. Cl.[7] ..... A63F 9/08
(52) U.S. Cl. ..... 273/153 S
(58) Field of Search ..... 273/153 S, 157 R, 273/153 R

(56) References Cited

U.S. PATENT DOCUMENTS

| | | | | |
|---|---|---|---|---|
| 420,300 | A | 1/1890 | Hicks | |
| 448,974 | A | 3/1891 | Lyon | |
| 507,215 | A | 10/1893 | Churchill | |
| 668,386 | A | 2/1901 | Moss | |
| 1,274,294 | A | 7/1918 | Lobl | |
| 1,555,980 | A | 10/1925 | Johnson | |
| D118,838 | S | 2/1940 | Roch | |
| 2,974,957 | A | 3/1961 | Steinhardt | 273/132 |
| 3,011,842 | A | 12/1961 | Norris | 308/188 |
| 3,081,089 | A | 3/1963 | Gustafson | 273/156 |
| 3,564,735 | A | 2/1971 | Fisher | 35/73 |
| 3,578,331 | A | 5/1971 | DeGast | 273/157 R |
| 3,608,906 | A | 9/1971 | Odier | 273/157 |
| 3,623,723 | A | 11/1971 | Helbach | 273/1 |
| 3,655,201 | A | 4/1972 | Nichols | 273/153 |
| 3,677,547 | A | 7/1972 | Hicks | 273/109 |
| 3,679,212 | A | 7/1972 | Smith | 273/144 |
| 3,706,457 | A | 12/1972 | Gonzales et al. | 273/153 |
| 3,726,527 | A | 4/1973 | Schauffler | 273/134 |
| D232,571 | S | 8/1974 | Coffin | D34/15 |
| D234,708 | S | 4/1975 | Rostock | D34/15 |
| D265,844 | S | 8/1982 | Simpson et al. | D21/1 |
| 4,377,286 | A | 3/1983 | Constantinescu | 273/153 |
| 4,378,117 | A | 3/1983 | Rubik | 273/153 |
| D269,629 | S | 7/1983 | Wiggs et al. | D21/1 |
| 4,415,158 | A | 11/1983 | Engel | 273/153 |
| 4,441,715 | A | 4/1984 | Titus | 273/153 |
| 4,454,454 | A | 6/1984 | Valentine | 318/293 |
| 4,478,418 | A | 10/1984 | Sherman, Jr. | 273/153 |
| 4,484,744 | A | 11/1984 | Gmunder | 273/153 |
| 4,522,401 | A | 6/1985 | Gustafson | 273/153 |
| 4,526,372 | A | 7/1985 | Kikis | 273/153 |
| 4,553,754 | A | 11/1985 | Wiggs et al. | 273/153 |
| 4,557,484 | A | 12/1985 | Sherman, Jr. et al. | 273/153 |
| 4,575,088 | A | 3/1986 | Peek | 273/153 |
| D283,523 | S | 4/1986 | Balint | D21/104 |
| 4,593,907 | A | 6/1986 | Abu-Shumays et al. | 273/153 |

(List continued on next page.)

FOREIGN PATENT DOCUMENTS

| | | | | |
|---|---|---|---|---|
| CH | SU 1158209 | | 5/1985 | |
| EP | 74308 | * | 3/1983 | 273/153 S |
| EP | 0578621 | | 1/1994 | |
| FR | 2493717 | | 5/1982 | |
| SU | 1391673 | * | 4/1988 | 273/153 S |
| WO | WO 82/01322 | | 4/1982 | |

OTHER PUBLICATIONS

Tierney, "The perplexing life of Erno Rubik," *Discover*, pp. 81–88, Mar. 1986.

Page 9 of a catalog relating to jigsaw puzzles that was published more than one year prior to the filing date of this application.

Tanner, Copyright Registration VAu 515–958 plus copy of deposit (3 pages total), Registration date of Apr. 16, 2001.

*Primary Examiner*—Steven Wong
(74) *Attorney, Agent, or Firm*—Fulbright & Jaworski L.L.P.

(57) ABSTRACT

Puzzles, including puzzles with substantially spherical bases and movable pieces. Some puzzles including bearings; some puzzles include at least one biasing structure; some puzzles include both; some puzzles include puzzle pieces that have raised bands.

44 Claims, 10 Drawing Sheets

U.S. PATENT DOCUMENTS

| | | | | |
|---|---|---|---|---|
| 4,597,579 | A | | 7/1986 | Walton ..... 273/156 |
| 4,625,967 | A | | 12/1986 | Yu ..... 273/153 |
| 4,735,417 | A | | 4/1988 | Gould ..... 273/153 |
| 4,744,350 | A | | 5/1988 | Sato ..... 128/57 |
| 4,832,343 | A | | 5/1989 | Bernat ..... 273/153 |
| 4,836,547 | A | | 6/1989 | Krikheli ..... 273/153 |
| 4,846,159 | A | | 7/1989 | Anzai et al. ..... 128/57 |
| 4,856,786 | A | | 8/1989 | Gyovai ..... 273/153 |
| 4,863,172 | A | | 9/1989 | Rosenwinkel et al. ..... 273/153 |
| 4,865,323 | A | | 9/1989 | Heusinkveld ..... 273/153 |
| 4,871,173 | A | | 10/1989 | Lammertink ..... 273/153 |
| 4,872,682 | A | | 10/1989 | Kuchimanchi et al. ..... 273/153 |
| 4,877,248 | A | | 10/1989 | Farraj ..... 273/153 |
| 4,877,406 | A | | 10/1989 | Wilk ..... 434/278 |
| 4,889,340 | A | | 12/1989 | Greene ..... 273/153 |
| 4,927,150 | A | | 5/1990 | Monoyios ..... 273/153 |
| 5,074,562 | A | | 12/1991 | Green ..... 273/153 |
| 5,114,148 | A | | 5/1992 | Liu ..... 273/153 |
| 5,215,305 | A | | 6/1993 | Hsun ..... 273/153 |
| 5,308,066 | A | | 5/1994 | Pataki et al. ..... 273/153 |
| 5,333,869 | A | * | 8/1994 | Hsun ..... 273/153 S |
| 5,389,063 | A | | 2/1995 | Wu ..... 601/135 |
| 5,449,175 | A | * | 9/1995 | Nagy et al. ..... 273/153 S |
| 5,452,895 | A | | 9/1995 | Ray ..... 273/153 |
| 5,566,941 | A | | 10/1996 | Destics ..... 273/153 |
| 5,836,584 | A | | 11/1998 | Chen ..... 273/153 |

* cited by examiner

PUZZLES

BACKGROUND OF THE INVENTION

1. Field of the Invention

The invention relates generally to puzzles. More specifically, the invention relates to substantially spherical puzzles with multiple moving pieces.

2. Description of Related Art

Puzzles provide a means for individuals to test a wide variety of skills. Those that are highly complex tax both the intellectual and the creative forces, as well as make use of the solver's problem-solving skills, aptitudes in finger dexterity, and structural visualization. Those that are less complex still provide a period of fun and entertainment as the player attempts to move toward the solution.

The most famous puzzle is the RUBIK'S CUBE, which enjoyed tremendous commercial success. However, it had certain shortcomings, one of which was the relative difficulty with which the cubes moved. Movement of the different cube pieces often became tight, stubborn, or jammed up. Since the release of the RUBIK'S CUBE, a number of more spherical puzzles have appeared. Examples of these appear in U.S. Pat. Nos. 4,625,967, 4,889,340, 5,074,562, 5,389,063, 5,452,895, 5,566,941, 5,836,584, D269,629, and D283,523. Foreign publications showing examples of more spherical puzzles include PCT/JP81/00225 (WO 82/01322) and European Publication No. 0573621.

Based on the disclosures in these patents and publications, it appears that at least some of these more spherical puzzles—such as those appearing in U.S. Pat. Nos. 4,889,340, 5,074,562, 5,389,063, 5,452,895, 5,566,941, and 5,836,584—also suffer from the shortcoming associated with non-smooth puzzle piece movement. While the puzzles are designed such that the puzzle pieces have defined tracks in which they move, if the puzzle pieces do not stop precisely in the right position at the intersections of the circumferential tracks, movement of all the puzzle pieces in an entire track cannot be made until the mis-aligned piece is properly positioned. Further, it is not clear that movement of the pieces of these puzzles within their respective tracks would be smooth in practice.

SUMMARY OF THE INVENTION

The present puzzles reduce or eliminate some or all of the shortcomings described above in a variety of different ways. For example, one embodiment of the present puzzles uses bearing over which puzzle pieces may slide. Another embodiment of the present puzzles includes at least one biasing structure, which tends to keep puzzles pieces positioned in certain locations in the circumferential track where the biasing structure resides. In other embodiments, multiple biasing structures are used. In still other embodiments, both bearings and at least one biasing structure are used.

The present puzzles offer additional advantages as well. In some embodiments of the present puzzles, the puzzles pieces have raised bands on their outer surfaces. The raised bands are attractive in appearance, and serve the function of challenging the user to arrange the pieces so that the bands line up correctly. In some of the present puzzles, certain pieces include raised crossed bands that should be positioned at the intersection of the circumferential tracks when the puzzles are solved. These puzzle pieces also contribute to the pleasing appearance and technically-challenging nature of those puzzles. The raised bands and raised crossed bands make those puzzles well-suited for use by the vision-impaired.

BRIEF DESCRIPTION OF THE DRAWINGS

The following drawings demonstrate certain aspects of some of the present puzzles. The drawings illustrate by way of example and not limitation. Like reference numbers refer to similar elements.

DESCRIPTION OF ILLUSTRATIVE EMBODIMENTS

In this document (including the claims), the terms "comprise" (and any form thereof, such as "comprises" and "comprising"), "have" (and any form thereof, such as "has" and "having"), and "include" (and any form thereof, such as "includes" and "including") are open-ended linking verbs. Thus, a puzzle or an aspect of a puzzle that "comprises," "has," or "includes" one or more elements possesses those one or more elements, but is not limited to possessing only those one or more elements.

For example, a substantially spherical base having at least two substantially perpendicular circumferential tracks is a base that has two such tracks, but is not limited to only have two such tracks. For example, such a base may have a third circumferential track.

The terms "a" and "an" mean one or more than one. The term "another" means at least a second or more. The term "multiple" means two or more. The term "substantially" means at least approaching a given state (e.g., preferably within 10% of, more preferably within 1% of, and most preferably within 0.5% of).

The present puzzles should appeal to all ages and may enhance certain skills and aptitudes in the very young while challenging the intellect of young and old alike. Certain of the present puzzles also form fascinating objects of art, especially when placed on a stand. Certain of the present puzzles are ideal office decorations, and may be left out on a desk or credenza as a conversation piece and/or as a challenge to visitors. Those who attempt to solve certain of the present puzzles will be challenged and tested in a variety of ways, and may have to use all of the skills and aptitudes at their disposal in order to successfully solve them.

Certain of the present puzzles may be used to promote a feeling of self-accomplishment and encourage the practice of motor skills. Certain of the present puzzles may also be an ideal test for structural visualization skills, which allows an individual to picture a structure three-dimensionally to better understand how pieces of the structure fit and work together.

Those of skill in the art will appreciate that in the detailed description below, certain well known components and assembly techniques are omitted so as not to obscure the present puzzles in unnecessary detail.

Figure 1:
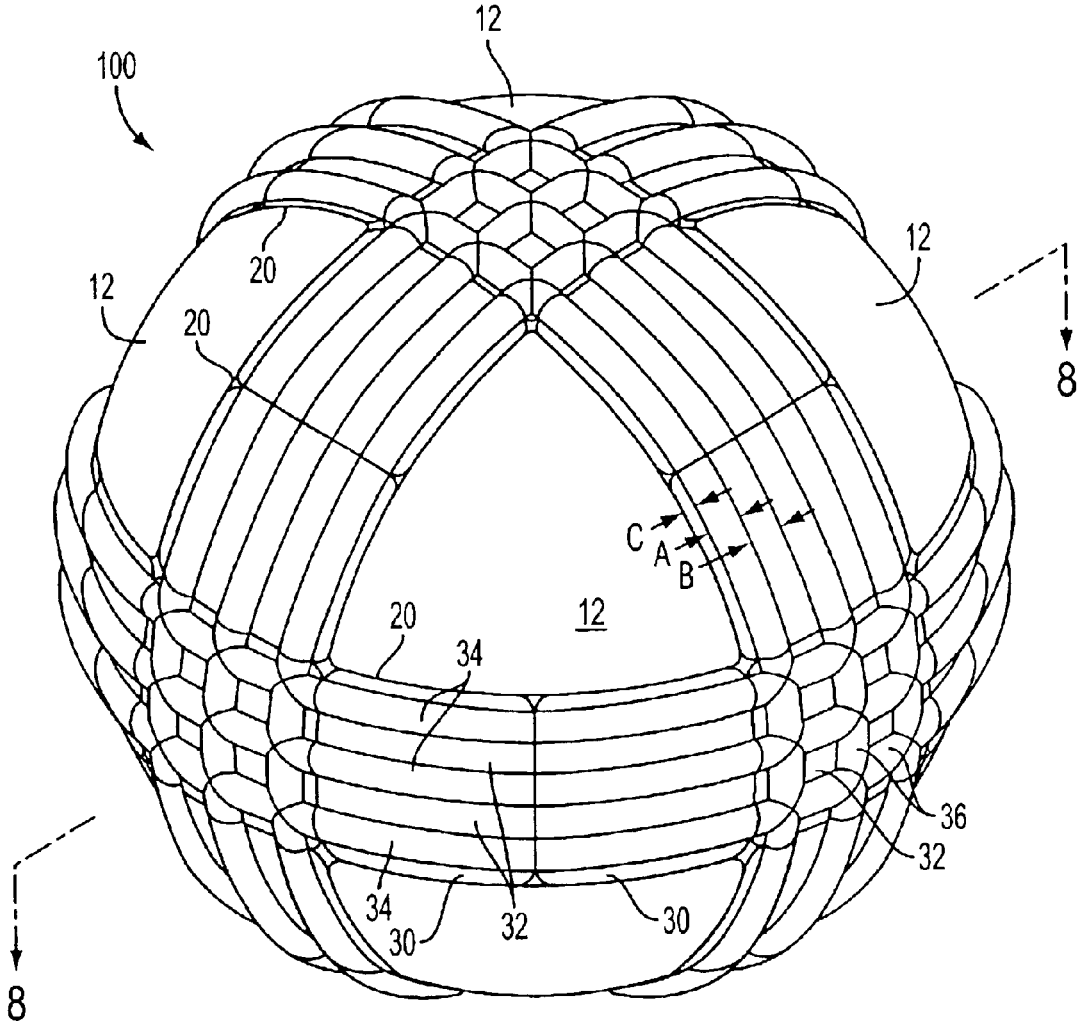
FIG. 1 shows a perspective view of one of the present puzzles in solved form.

FIG. 1 shows one version of the present puzzles. Puzzle 100 is shown in its solved configuration. It includes a substantially spherical base 10 that has three substantially perpendicular tracks 20 in which puzzle pieces 30 are slidably positioned. The details of tracks 20 are not visible because of the presence of puzzle pieces 30 but will be shown and described in greater detail below. Tracks 20 are circumferentially arranged about substantially spherical base 10, meaning the tracks are positioned about the perimeter of the base. Substantially spherical base 10 may also include outer surface 12, visible in eight spots between tracks 20 (only 5 of which are clearly visible in FIG. 1).

Continuing with FIG. 1, each puzzle piece 30 includes an outer surface 32 on which either raised bands 34 or raised crossed bands 36 are disposed. More specifically, as FIG. 1 shows, three raised bands 34 may be disposed in parallel relationship with each other on outer surface 32 of some of puzzle pieces 30, and six raised crossed bands 36 may be disposed on outer surface 32 of other of puzzle pieces 30.

In one embodiment, each track 20 may hold twelve (12) puzzle pieces 30. Considering that puzzle 100 is substantially symmetrical in shape, and considering that the puzzle pieces at the intersections of tracks 20 are shared by two of the tracks, the total number of puzzle pieces 30 slidably disposed in substantially spherical base 10 of puzzle 100 is 30. Of these, the total number of puzzle pieces 30 having raised crossed bands 36 disposed on their outer surfaces is six (6); and the total number of puzzle pieces 30 having raised bands 34 disposed on their outer surfaces is 24.

Continuing with FIG. 1, in one embodiment of the present puzzles, dimension A, which represents the width of one of the raised bands 34, may be substantially equal to dimension B, which represents the width of the space between adjacent raised bands 34. In one embodiment, dimension C, which represents the distance between an outer edge of the outer surface of a given puzzle piece 30 and the outer edge of an adjacent band, may have approximately one-half the value of dimension B. In another embodiment, dimension C may have approximately one-half the value of dimension A. In still other embodiments, dimension C may be a smaller fraction of either dimension A or B. The existence of dimension C should add to the visual appeal of puzzle 100 when unsolved. By way of example, when two puzzle pieces 30 having raised bands are arranged within a track such that the bands are positioned six across rather than end-to-end, the existence of dimension C separates the two adjacent raised bands on the different pieces such that the two bands do not appear as one wide band.

Many different color combinations may be applied to outer surfaces 32 of puzzle pieces 30, outer surface 12 of substantially spherical base 10, and bands 34 and 36. For example, black may be used as the color for outer surfaces 32 and 12, and silver or gold—such as glossy, or shiny, silver or gold—may be used for bands 34 and 36. Alternatively, white may be used for outer surfaces 32 and 12, and red, blue, or green (including any shade of any of these) may be used in any combination for bands 34 and 36. Additional color combinations will be discussed in greater detail below.

Figure 2:
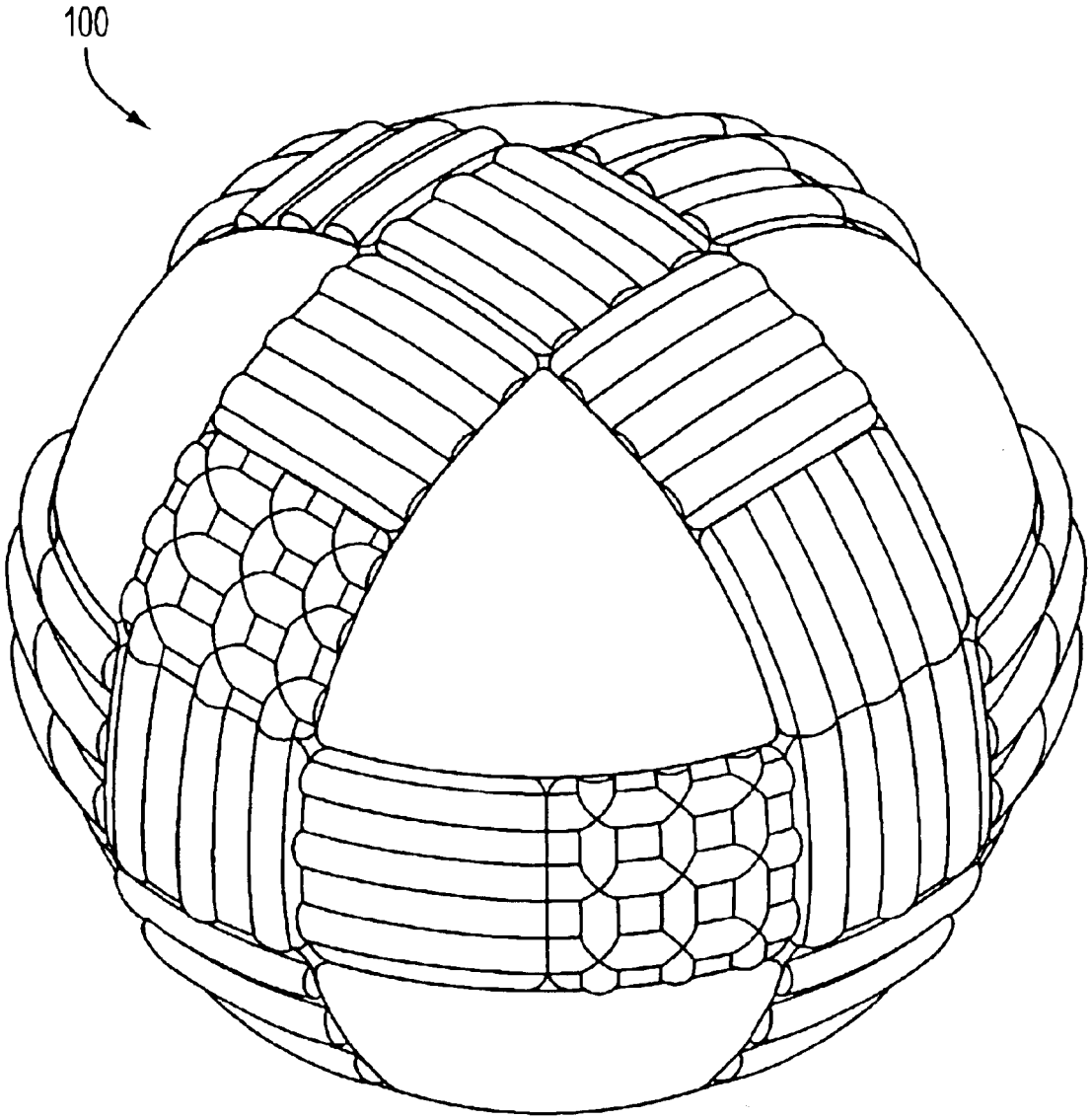
FIG. 2 shows a perspective view of the puzzle of FIG. 1 in scrambled, or unsolved, form.

FIG. 2 shows puzzle 100 in a scrambled, or unsolved, state. Having been provided in FIG. 1, element numbers have been omitted from FIG. 2 so as not to obscure the appearance of the puzzle.

Figure 3:
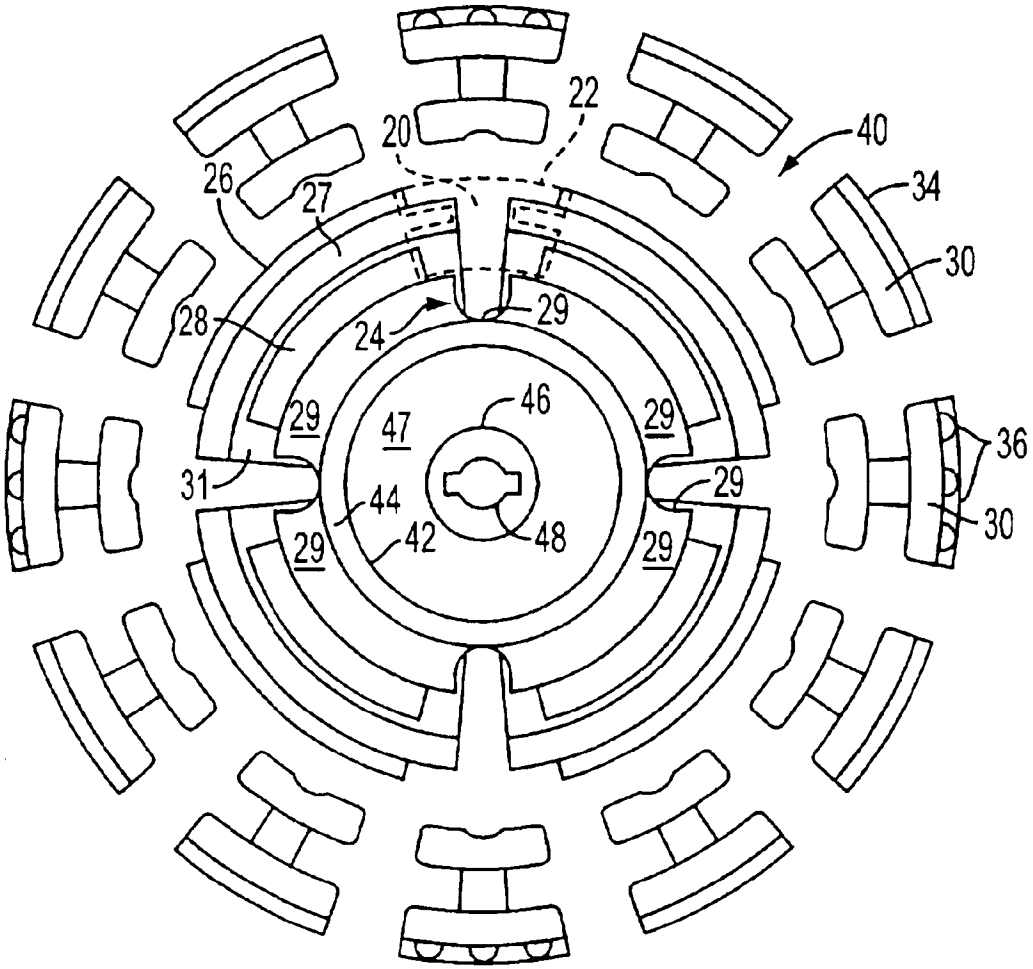
FIG. 3 shows a core half of the one of the present puzzles along with certain puzzle pieces in an exploded arrangement around the core half.

The substantially spherical base shown in FIGS. 1 and 2 may comprise a core that includes two core portions or halves. One such core half is shown in FIG. 3 at element 40. Two such core halves are shown in the embodiment of the present puzzles shown in FIG. 4. FIG. 3 shows circumferential tracks 20 as being comprised of puzzle piece holding portion 22, designated generally by dotted lines for clarity, and bearing portion 24. Puzzle pieces 30 are shows in exploded fashion around core half 40, positioned generally above the positions in which they would respectively be after assembly.

The portions of core half 40 that define tracks 20 include a number of circumferential track defining portions. These circumferential track defining portions include upper portion 26, middle portion 27, and lower portion 28. Together, upper, middle, and lower portions 26–28, respectively, define puzzle piece holding portions 22. As shown in FIG. 3, middle portions 27 are wider than both upper portions 26 and lower portions 28. The underside, or bottom surface, of middle portion 27 is designated by element 31.

Each of these track defining portions is characterized by respective perimeter. The perimeters are triangular in shape. One side of each of the perimeters is visible in FIG. 3. The entirety of the upper and middle perimeters 57 and 59, respectively, is visible in FIG. 5. The lower perimeter, although not shown in its entirety in any figure, is similar in shape and dimension to upper perimeter 57 shown in FIG. 5. The middle the middle perimeter is greater than both the upper and lower perimeters.

FIG. 3 also shows two of the three circumferential grooves 29 that may be provided in core half 40 in complete detail, and shows one-half of the third circumferential groove. Grooves 29 may be slightly less than one half of a sphere in shape and, as such, are configured to accept bearings, such as ball bearings, that help make movement of puzzle pieces 30 about tracks 20 easy and smooth. Grooves 29 are also considered to be aspects of the circumferential track defining portions, and serve to define bearing portions 24.

Core half 40 shown in FIG. 3 also includes shoulder 42, which has a flat face 44 that is suited to butting up against a flat face of an adjacent shoulder from the other core half. Core half 40 also includes connector 46, which includes mating recess 48. The portion of core half 40 between shoulder 42 and connector 46 may be routed out, as shown in FIG. 3, to form recess 47. The depth of recess 47 may be dictated by, for example, manufacturing considerations, and/or by the desired weight of the puzzle. If injection molding is used to create puzzle 100, the presence of recess 47 may be desirable because less material would be used (the complexity of the mold might offset the savings in material, however). Alternatively, if core halves 40 are created using machining techniques, and recess 47 would have to be routed out, recess 47 may be dispensed with, and connector 46 and shoulder 42 may be effectively merged into one flat surface.

In either version, a mating projection that is comparably shaped to mating recess 48 may be provided on a connector on the other core half. When the two core halves are joined together, the mating projection from one will fit into the mating recess of the other, and the opposing shoulders and connectors will butt up against each other. Some examples of methods of joining two core halves together—which will depend in large part on the materials used to make the puzzle—include a friction fit, a friction fit coupled with the use of an adhesive, a threaded connection (such that at least one thread is provided in mating recess 48 and a complimentarily-shaped thread is provided on the outside of the mating projection of the other core half), a mating projection with a split and a mating lip that allows two mating projection portions to be compressed as they enter the mating recess and then expand such that the lip catches on some portion of the recess, and the like.

As discussed below, core half 40 can be formed from a solid piece of material that is routed out with tracks 20. Alternatively, core half 40 may be injection molded to have the shape shown in FIG. 3. As still another alternative, core half 40 may not include upper, middle, and lower portions 26, 27, and 28, respectively, but would still include the three grooves 29 shown in FIG. 3. In such an embodiment, upper, middle, and lower circumferential track defining portions 26, 27, and 28 may be attached to core 40 as separate pieces. Methods of attachment including gluing or otherwise using an adhesive, treatment with heat, or a mechanical connection of some kind, such as snaps or providing the core half with female recesses and the three portions with mating male portions. At least one thread could be provided in the female recesses and at least one complimentary male thread provided on the three portions.

Figure 4:
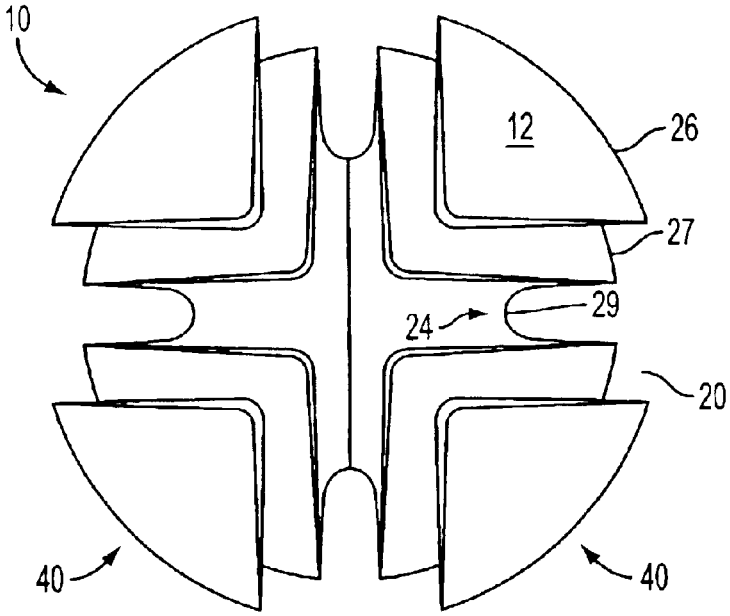
FIG. 4 shows a perspective view of two core halves connected together and making up one of the present substantially spherical bases.

FIG. 4 shows two core halves 40 put together to form substantially spherical base 10. Of the circumferential track defining portions shown, lower portion 28 is not visible. Similarly, puzzle piece holding portion 22 is not entirely visible in FIG. 4.

Figure 5:
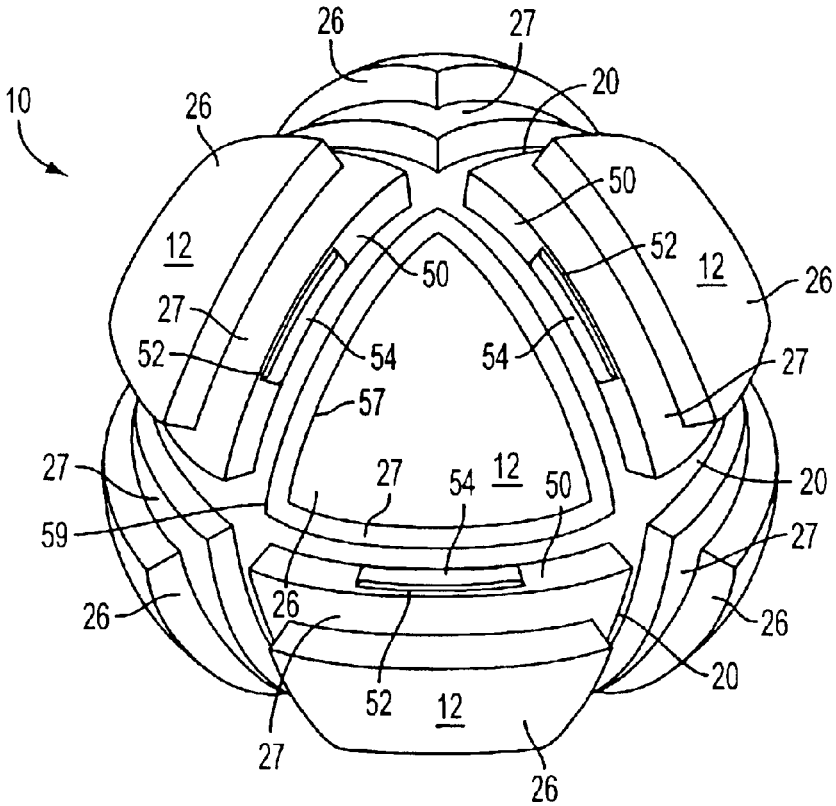
FIG. 5 is a perspective view of one of the present substantially spherical bases.

FIG. 5 shows a different view of view of substantially spherical base 10. FIG. 5 shows tracks 20 and upper and middle circumferential track defining portions 26 and 27, respectively. Middle portions 27 include sides. More specifically, FIG. 5 shows that three of the five middle portions 27 shown include track surfaces 50, which border portions of tracks 20 and further define biasing structure recesses 52. Positioned within the three biasing structure recesses shown in FIG. 5 are biasing structures 54. Biasing structures 54 provide a means of keeping the puzzle pieces in the tracks in their correct positions so that the pieces are more likely centered at the intersections of the tracks. In short, the biasing structures help to 'snap' the puzzle pieces into place, and make the puzzles in which they are used more user friendly. As a result, it will be easy to rotate the puzzle pieces smoothly around the tracks and change directions at the intersections of the tracks. More details on the operation of exemplary biasing structures is provided below. Although FIG. 5 shows the use of three biasing structures, in another embodiment of the present puzzles, only one biasing structure is used. In still another embodiment, only two biasing structures are used. In order to make the details of what is shown in FIG. 5 more clear, grooves 29 and lower track defining portions 28 have been omitted from view.

Figure 6A:
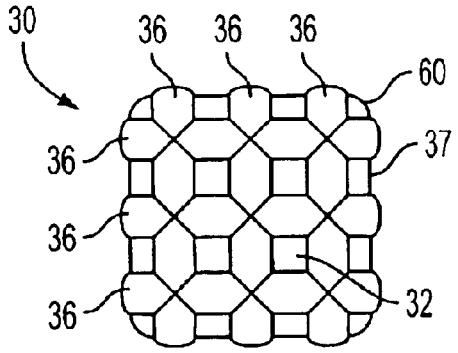
FIG. 6A is a top view of one of the present puzzle pieces on which raised cross bands are disposed.
Figure 6B:
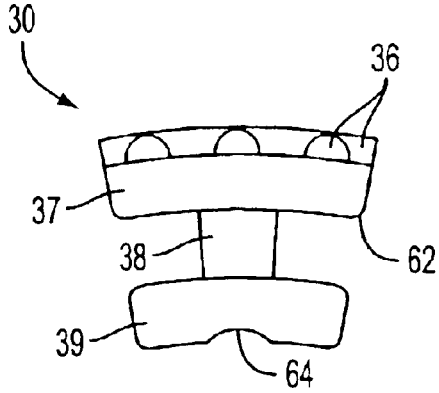
FIG. 6B is a side view of the puzzle piece shown in FIG. 6A.

FIGS. 6A and 6B show top and side views, respectively, of a puzzle piece 30 with raised crossed bands 36 disposed on outer surface 32. The puzzle piece shown has three raised bands arranged in parallel, which cross (at a right angle) three other raised bands arranged in parallel. Although 6 total bands are shown in these figures, other arrangements that are not shown are possible. For example, instead of the 3-by-3 arrangement shown in FIGS. 6A and 6B, a 1-by-1, a 2-by-2, a 4-by-4, or a 5-by-5 arrangement may also be used. In fact, other combinations such as a 1-by-2, a 1-by-3, a 1-by-4, a 1-by-5, a 2-by-3, a 2-by-4, a 2-by-5, a 3-by-4, a 3-by-5, or a 4-by-5 arrangement could also be used. In accordance with these combinations, puzzle pieces with raised bands (such as those shown in FIGS. 6C and 6D) may be provided with an appropriate number of raised bands 34. For example, for a 1-by-1 arrangement, 24 puzzle pieces could be provided with one raised band 34, and 6 puzzle pieces could be provided with two raised crossed bands 36; for a 2-by-2 arrangement, 24 puzzle pieces could be provided with two raised bands 34, and 6 puzzle pieces could be provided with four raised crossed bands 36; and so on. For a 1-by-2 arrangement, 4 puzzle pieces with a 1-by-2 arrangement would be needed, two puzzle pieces with a 2-by-2 arrangement would be needed, 16 puzzle pieces with two raised bands 34 would be needed, and 8 puzzle pieces with one raised band 34 would be needed. An alternative 1-by-2 arrangement includes 4 puzzle pieces with a 1-by-1 arrangement, two puzzle pieces with a 1-by-2 arrangement, 16 puzzle pieces with one raised band 34, and 8 puzzle pieces with two raised bands 34. The same proportions apply to 1-by-3, 1-by-4, and 1-by-5, etc., arrangements. Other arrangements than those listed here are, of course, possible.

Figure 7:
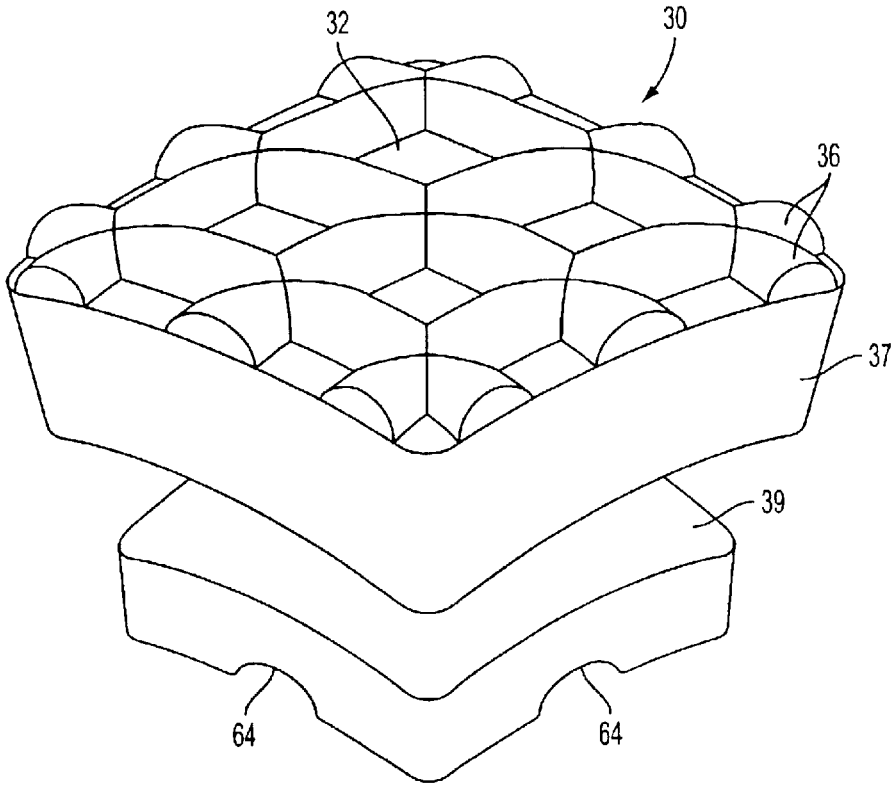
FIG. 7 is a perspective view of the puzzle piece shown in FIGS. 6A and 6B.

As FIG. 6B shows, puzzle piece 30 includes top portion 37, middle portion 38, and bottom portion 39. Top portion may be square in shape, as shown in FIG. 6A. Other shapes such as diamonds, stars, triangles, and circles may also be used. Outer upper edge 60 of top portion 39 may be rounded as shown in FIG. 6A, or may be square. The sides and underside of top portion 37 may also meet in a rounded (FIG. 6B) or square edge, as may the sides and outer surface 32 of top portion 37. Middle portion 38 may be rounded, square, or otherwise rectangular. Bottom portion 39 may be square in shape, although other shapes such as diamonds, stars, triangles, and circles may also be used. Bottom portion 39 includes bearing recesses 64 (only one is visible in FIG. 6B). FIG. 7 is a perspective view of the puzzle piece shown in FIGS. 6A and 6B.

Figure 6C:
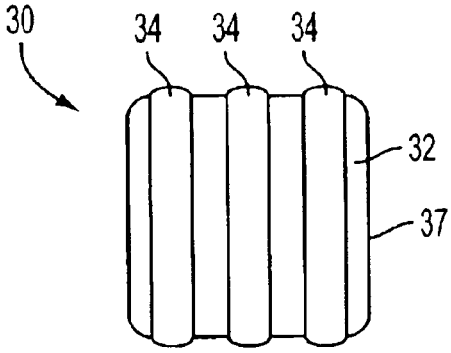
FIG. 6C a top view of one of the present puzzle pieces on which raised bands are disposed.
Figure 6D:
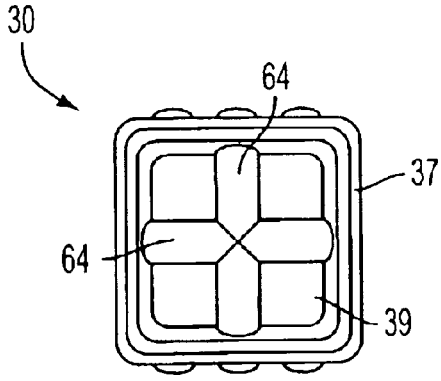
FIG. 6D is a bottom view of the puzzle piece shown in FIG. 6C.

FIGS. 6C and 6D show different views of a puzzle piece 30 with raised bands 34 disposed on outer surface 32. The underside of bottom portion 39 is visible in FIG. 6D. More specifically, both bearing recesses 64 in the bottom of bottom portion 39 are visible in FIG. 6D. Bottom portion 39 of the present puzzle pieces need not include the bearing recesses shown in FIGS. 6B, 6D, 7 and 8. To the extent used, the bearing recesses should be shallow enough that when the bearings are not aligned at an intersection of two tracks, and the user desires to move the puzzle pieces over the non-aligned bearings, the bearing recesses of those puzzle pieces will slide over the misaligned bearings. This will occur provided there is enough "give" in the general construction of the puzzle. When the bearing recesses are not used, movement of all puzzle pieces will be smooth, and no misalignment of bearings can, or will, occur.

The upper, middle, and lower portions of the present puzzle pieces may be formed from the same piece of material (e.g., through machining or molding), or they may be separate pieces of material that are attached to each other using any process suited to joining the selected materials.

Figure 8:
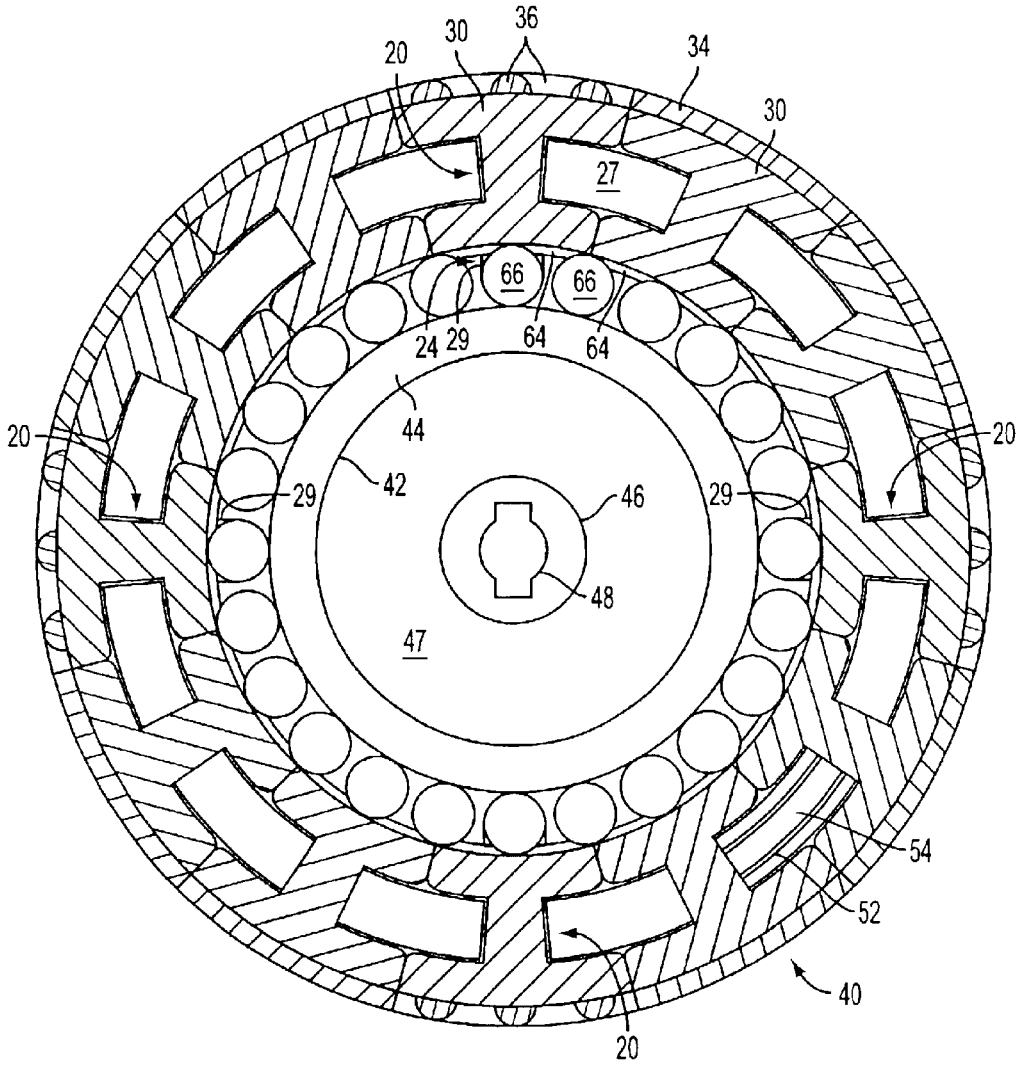
FIG. 8 is a view of one of the two core halves making up the puzzle shown in FIG. 1, and is taken along line 8—8 in FIG. 1. The puzzle pieces in FIG. 8 are shown in cross section, but the core half and bearings visible in the figure are not in cross section.

FIG. 8 depicts core half 40. It also depicts puzzle pieces 30 in a cross section taken along line 8—8 shown in FIG. 1, as viewed from the perspective of the eyeball shown in FIG. 1. Bearings 66, which may be ball bearings, are positioned in bearing portions 24. Twenty-four bearings 66 are shown as positioned in the half of bearing portion 29 that faces the viewer in FIG. 8. Four of those bearings are also positioned in the other two bearing portions 24 (and, consequently, grooves 29). In one embodiment of the present puzzles, 66 total bearings may be used. In other embodiments, fewer bearings may be used, including, in total, 65, 64, 63, 62, 61, 60, 59, 58, 57, 56, 55, 54, 53, 52, 51, or 50 bearings, which may be ball bearings.

Figure 9A:
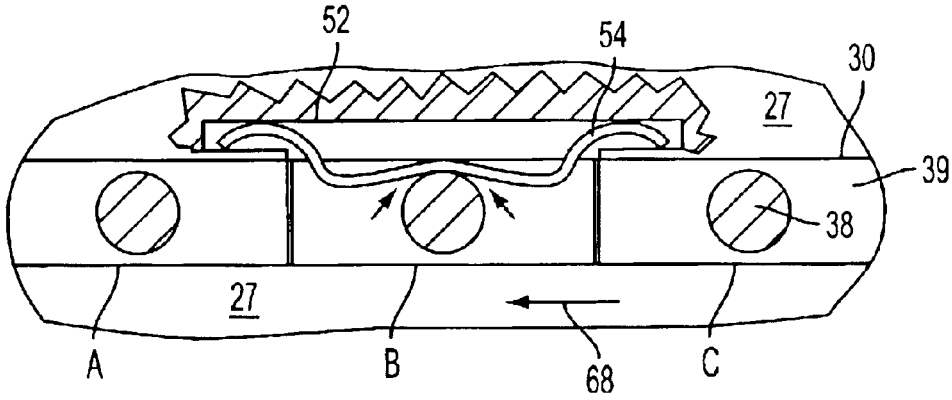
FIGS. 9A and 9B are detail views of a portion of one of the present puzzles, and demonstrate the operation of one of the present biasing structures.
Figure 9B:
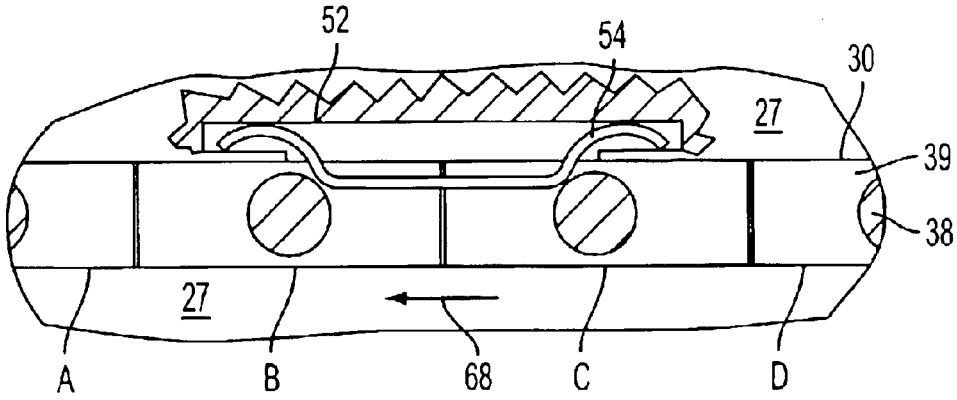

FIGS. 9A and 9B show how biasing structure 54 operates. FIG. 9A is a top view of a portion of puzzle 100. It shows three puzzle pieces 30—further specified as A, B, and C—in a cross section of middle portion 38. Bottom portion 39 of the puzzle pieces shown in FIGS. 9A and 9B are shown only to the extent that they are visible between opposing middle track defining portions 27. FIG. 9A also shows a broken out view of biasing structure recess 52 in middle track defining portion 27. In this view, biasing structure 54 is visible in biasing structure recess 52. FIG. 9A also shows that as middle puzzle piece B passes by biasing structure 54 in the direction of arrow 68, the middle portion of that puzzle piece depresses biasing structure 54 as indicated by the smaller arrows.

FIG. 9B shows biasing structure 54 in its uncompressed state and puzzle piece B positioned past biasing structure 54. The resilience of biasing structure 54 should help to move puzzle piece B in the direction of arrow 68. Puzzle piece D has come into view in FIG. 9B by virtue of the movement of puzzle pieces A, B, and C. In one embodiment, biasing structure 54 may be made from an elongated piece of metal fashioned into a leaf spring, as shown in FIGS. 9A and 9B. Resilient materials such as stainless steel or nitinol may be used for the leaf spring. Alternatively, the present biasing structures may take the form of coiled springs or resilient sponges placed into appropriately shaped recesses in middle track defining portion 27. Depending on the size of the sponge or coiled spring, it may be possible to dispense with the need for a recess, and simply attach the spring or sponge to the appropriate track surface 50 (see FIG. 5). Moreover, the same is true of the present leaf springs. Preferably, biasing structure 54 should be made from a material that substantially retains its original shape after that shape is altered through the application of some force.

Figure 10:
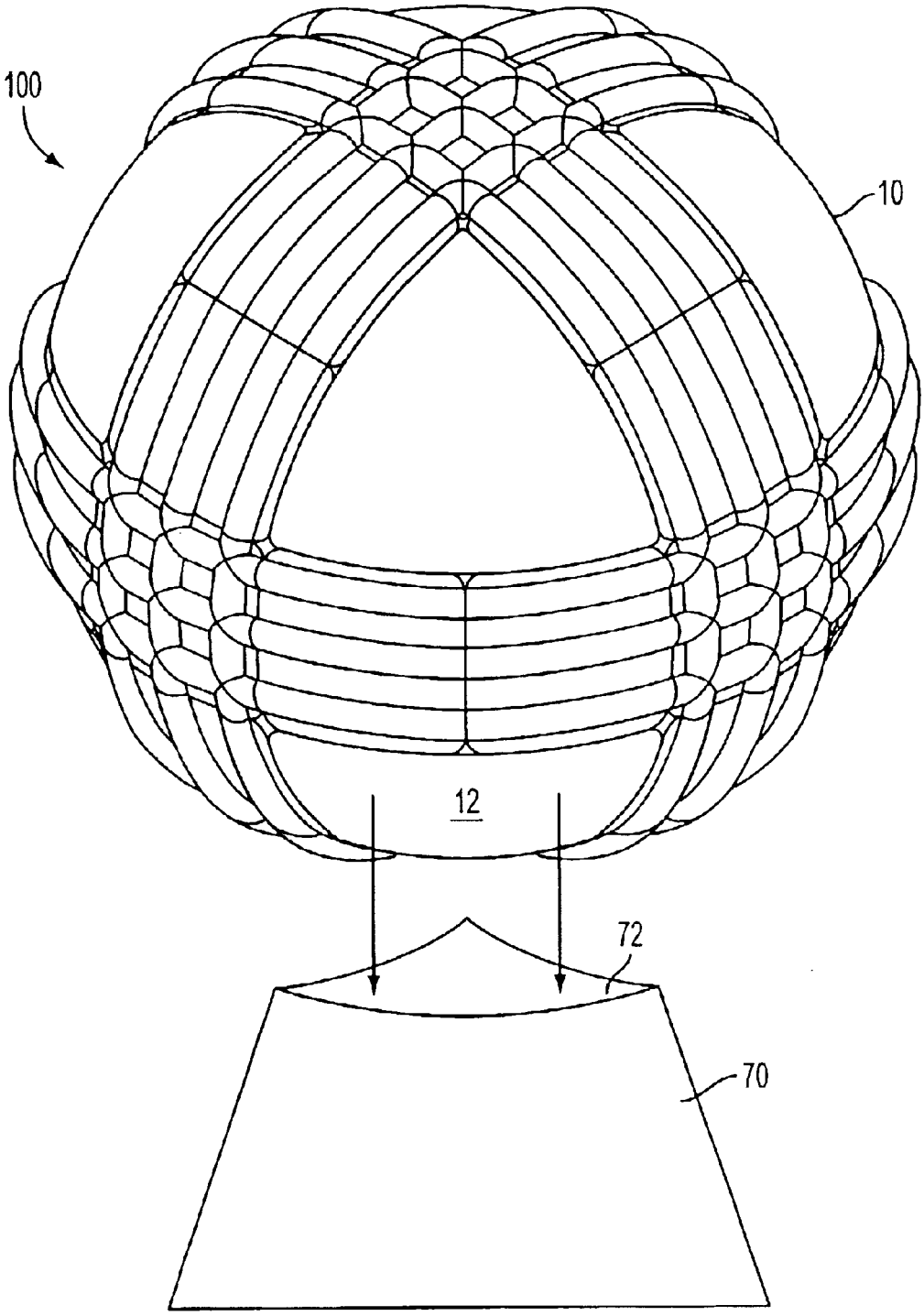
FIG. 10 is a perspective view showing how the puzzle from FIG. 1 may be positioned over and eventually placed on one of the present stands.

FIG. 10 is a perspective view of solved puzzle 100, positioned over a stand, or base, 70. Base 70 has top surface 72 that is the same size as one of the eight exposed sections of outer surface 12 of substantially spherical base 10. Any of the present puzzles may be placed on such a base when not being used. The base may add to the aesthetic appeal of the puzzle by showcasing it and setting the puzzle apart from the surface on which the base sits. The base may be generally triangularly shaped as shown in FIG. 10.

Figure 11:
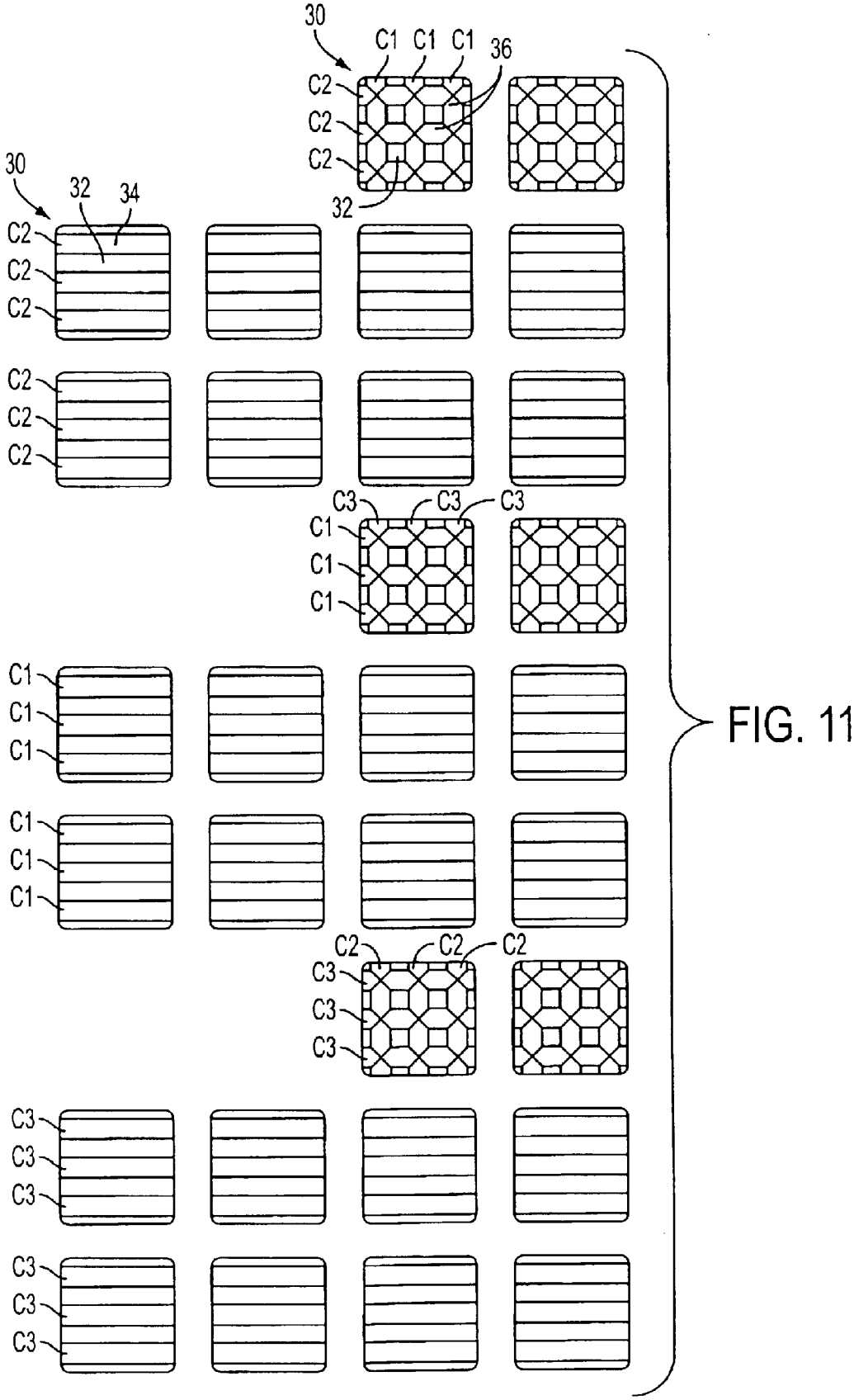
FIG. 11 shows one version of the configurations, including raised band pattern and color combinations, for the present puzzle pieces.

FIG. 11 shows one embodiment of a combination of color arrangements that may be used on puzzle pieces 30 of one of the present puzzles. Designations C1, C2, and C3 have been given to the leftmost puzzle piece in each row of puzzle pieces. Each such designation represents a color, and the same designation will be understood to apply to each puzzle piece in that particular row. To this end, C1 may be red or any shade of red; C2 may be blue or any shade of blue; and C3 may be green or any shade of green, including a light green. The outer surfaces 32 of each of the puzzle pieces, as well as outer surface 12 of a substantially spherical base 10, may be white or black consistent with this color arrangement.

Other colors and styles may also be used for the various surfaces and bands of the present puzzles. For example, the outer surface (e.g., outer surface 12) of the substantially spherical base (e.g., substantially spherical base 10) and the outer surfaces of the puzzle pieces (e.g., outer surface 32) of one of the present puzzles may be given a glossy metallic blue finish, or color, and the bands on the puzzle pieces (including the raised bands and the raised cross bands) may be gold in color, such as a shiny gold. Instead of glossy metallic blue finish, a pearl-like blue finish—producing a look that is comparable to that of an oyster pearl—may be used for the outer surface of the substantially spherical base and the outer surface of the puzzle pieces. Moreover, these outer surfaces may be a glossy metallic or pearl-like red, green, black, or white color, while the bands on the puzzle pieces may be gold or silver in color, such as shiny gold or silver. In other embodiments, these colors may have a matte, or flat, finish. The glossy metallic, pearl-like, and matte finishes may be used for any of the colors disclosed in any of the combinations disclosed.

The present puzzles may be constructed from any suitable material, including, for example, either plastic or metal. In one embodiment, the puzzle may be about 2.5 to 3 inches in diameter. However, other sizes are possible. For example, the present puzzles may be sold in small (e.g., about 2.5 inches in diameter), medium (e.g., about 5 inches in diameter), and large (e.g., about 7.5 inches in diameter) sizes. In choosing materials from which to make the substantially spherical base and puzzle pieces, care should be taken to use materials that will make it easy to move the puzzle pieces smoothly within their track or tracks. While features such as biasing structures and/or bearings should contribute to the smooth functioning of certain of the present puzzle pieces, material selection may also play a role to such smooth functioning.

In one embodiment, the puzzle pieces (including raised bands) and core halves may be constructed using injection molding processes and formed from a plastic material, such as a high-impact plastic. In one embodiment, polyethylene may be used. In another embodiment, polystyrene may be used. Dies may be added to thermoplastic compounds during the heating and mixing stages of injection molding to achieve the desired colors of the puzzle pieces and core halves. After molding is complete, the puzzle pieces and core halves may be finished, if necessary, using any suitable technique. Alternatively, the raised bands may be added to the outer surfaces of the puzzle pieces after the injection molding process is complete, and secured to such outer surfaces using any suitable means, such as adhesive, heat treatment, or the like.

In another embodiment, the puzzle pieces (including raised bands) and core halves may be made of a metal, such as aluminum (e.g., brushed aluminum). In such an embodiment, the puzzle pieces and core halves may be machined to achieve their final shape. Stainless steel may also be used in this fashion, as may nickel, titanium, and even materials such as platinum, silver, or gold.

It may be desirable to form the various parts making up certain of the present puzzles from scratch-resistant materials, to minimize the effects of everyday wear and tear.

Such puzzles may be subject to frequent manipulation, placed on hard surfaces and/or dropped, and placed on its stand.

The individual components described above need not be made in the exact disclosed forms, or combined in the exact disclosed configurations, but may be provided in any suitable form, and/or combined in any suitable configuration. It will be clear that other various substitutions, modifications, additions and/or rearrangements of the features of the present puzzles may be made without deviating from their scope, which is defined by the claims and their equivalents. For example, to make certain of the present puzzles even more versatile, the height of the raised bands could be increased and/or raised bumps, or dots, may be added to form Braille letters so that the particular puzzle may be even more appealing for vision-impaired persons. Such a puzzle may also be used to teach or practice Braille.

As other examples, exotic materials such as ivory may be used for the puzzle pieces and core halves of one of the present puzzles. Further, a carrying case, such as one made of nylon, may be provided with the present puzzles.

The claims are not to be interpreted as including means-plus-function limitations, unless such a limitation is explicitly recited in a given claim using the phrase(s) "means for."

I claim:

1. A puzzle comprising:

a substantially spherical base having at least first and second substantially perpendicular circumferential tracks, each circumferential track including (a) a puzzle piece holding portion defined in part by a bottom surface and (b) a ball-bearing groove in the bottom surface;

ball bearings positioned in the ball-bearing groove of at least one of the circumferential tracks; and puzzle pieces slidably positioned in the puzzle piece holding portion of each circumferential track.

2. The puzzle of claim 1, the substantially spherical base having a third circumferential track substantially perpendicular to each of the first and second circumferential tracks.

3. The puzzle of claim 1, the substantially spherical base further having at least one circumferential track surface bordering a portion of at least one of the circumferential tracks and defining a biasing structure recess; the puzzle further comprising:

a biasing structure positioned in the biasing structure recess.

4. The puzzle of claim 3, the biasing structure comprising a leaf spring.

5. The puzzle of claim 1, the substantially spherical base having a third circumferential track substantially perpendicular to each of the first and second circumferential tracks; and circumferential track surfaces, each circumferential track surface being positioned in a portion of a respective circumferential track and defining a biasing structure recess; the puzzle further comprising:

a biasing structure positioned in each biasing structure recess.

6. The puzzle of claim 5, each biasing structure comprising a leaf spring.

7. The puzzle of claim 5 further comprising a base on which the substantially spherical base may be placed.

8. The puzzle of claim 5 further comprising a bag configured to hold the substantially spherical base.

9. The puzzle of claim 1, at least one of the puzzle pieces having an outer surface on which either raised bands or raised crossed bands are disposed.

10. The puzzle of claim 1, each of the puzzle pieces having an outer surface on which either raised bands or raised crossed bands are disposed.

11. The puzzle of claim 10, the puzzle pieces comprising 30 puzzle pieces.

12. The puzzle of claim 1, the substantially spherical base further having a core including two core portions.

13. The puzzle of claim 12, the substantially spherical base having a third circumferential track substantially perpendicular to each of the first and second circumferential tracks; the core further having circumferential track defining portions that define the first, second, and third circumferential tracks.

14. The puzzle of claim 13, at least one of the circumferential track defining portions comprising an upper portion defined by an upper portion perimeter, a middle portion defined by a middle portion perimeter, and a lower portion defined by a lower portion perimeter, the middle portion perimeter being greater than both the upper portion perimeter and the lower portion perimeter.

15. A puzzle comprising:

a substantially spherical base having at least first and second substantially perpendicular circumferential tracks, each circumferential track including a puzzle piece holding portion, and at least one circumferential track surface positioned in a portion of at least one of the circumferential tracks and defining a biasing structure recess;

a biasing structure positioned in the biasing structure recess; and puzzle pieces slidably positioned in the puzzle piece portion of each circumferential track;

the biasing structure applying non-radial pressure to puzzle pieces.

16. The puzzle of claim 15, the biasing structure comprising a leaf spring.

17. The puzzle of claim 15, the substantially spherical base having a third circumferential track substantially perpendicular to each of the first and second circumferential tracks; and circumferential track surfaces, each circumferential track surface being positioned in a portion of a respective circumferential track and defining a biasing structure recess; the puzzle further comprising:

a biasing structure positioned in each biasing structure recess.

18. The puzzle of claim 17 further comprising a base on which the substantially spherical base may be placed.

19. The puzzle of claim 17 further comprising a bag configured to hold the substantially spherical base.

20. The puzzle of claim 17, each biasing structure comprising a leaf spring.

21. The puzzle of claim 15, at least one of the puzzle pieces having an outer surface on which either raised bands or raised crossed bands are disposed.

22. The puzzle of claim 15, each of the puzzle pieces having an outer surface on which either raised bands or raised crossed bands are disposed.

23. The puzzle of claim 22, the puzzle pieces comprising 30 puzzle pieces.

24. The puzzle of claim 15, the substantially spherical base further having a core comprising two core portions and three circumferential grooves, each groove configured to accept bearings.

25. The puzzle of claim 24, the substantially spherical base having a third circumferential track substantially perpendicular to each of the first and second circumferential tracks, the substantially spherical base further having circumferential track defining portions attached to the core so as to define the first, second, and third circumferential tracks.

26. The puzzle of claim 25, at least one of the circumferential track defining portions comprising an upper portion defined by an upper portion perimeter, a middle portion defined by a middle portion perimeter, and a lower portion defined by a lower portion perimeter, the middle portion perimeter being greater than both the upper portion perimeter and the lower portion perimeter.

27. A puzzle comprising:

a substantially spherical base having at least first and second substantially perpendicular circumferential tracks, each circumferential track including a puzzle piece holding portion; and puzzle pieces slidably positioned in the puzzle piece holding portion of each circumferential track, first and second puzzle pieces each having an outer surface on which raised bands are disposed, and one of the puzzle pieces having an outer surface on which raised crossed bands are disposed;

a first raised band of the raised crossed bands being positioned so as to be substantially aligned with a raised band on the first puzzle piece when the puzzle is in a solved position, and a second raised band of the raised crossed bands that crosses the first raised band being positioned so as to be substantially aligned with a raised band on the second puzzle piece when the puzzle is in a solved position.

28. The puzzle of claim 27, the substantially spherical base further having at least a third circumferential tracks substantially perpendicular to each of the first and second circumferential tracks.

29. The puzzle of claim 28, each of the puzzle pieces having an outer surface on which either raised bands or raised crossed bands are disposed.

30. The puzzle of claim 29 further comprising a base on which the substantially spherical base may be placed.

31. The puzzle of claim 29 further comprising a bag configured to hold the substantially spherical base.

32. The puzzle of claim 29, the puzzle pieces comprising 30 puzzle pieces.

33. The puzzle of claim 27, the substantially spherical base further having a core comprising two core portions.

34. The puzzle of claim 33, the substantially spherical base having a third circumferential track substantially perpendicular to each of the first and second circumferential tracks, the substantially spherical base further having circumferential track defining portions attached to the core so as to define the first, second, and third circumferential tracks.

35. The puzzle of claim 34, at least one of the circumferential track defining portions comprising an upper portion defined by an upper portion perimeter, a middle portion defined by a middle portion perimeter, and a lower portion defined by a lower portion perimeter, the middle portion perimeter being greater than both the upper portion perimeter and the lower portion perimeter.

36. The puzzle of claim 1, where ball bearings are positioned in the bearing portion of each circumferential track.

37. A puzzle comprising:

a substantially spherical base having at least first and second substantially perpendicular circumferential tracks, each circumferential track including a puzzle piece holding portion, and at least one circumferential track surface positioned in a portion of at least one of the circumferential tracks and defining a biasing structure recess;

a biasing structure positioned in the biasing structure recess; and puzzle pieces slidably positioned in the puzzle piece portion of each circumferential track;

the biasing structure recess being configured such that the biasing structure flexes in a lateral direction in response to contact by a passing puzzle piece.

38. The puzzle of claim 37, the biasing structure comprising a leaf spring.

39. The puzzle of claim 37, the substantially spherical base having a third circumferential track substantially perpendicular to each of the first and second circumferential tracks; and circumferential track surfaces, each circumferential track surface being positioned in a portion of a respective circumferential track and defining a biasing structure recess; the puzzle further comprising:

a biasing structure positioned in each biasing structure recess.

40. The puzzle of claim 39 further comprising a base on which the substantially spherical base may be placed.

41. The puzzle of claim 39 further comprising a bag configured to hold the substantially spherical base.

42. The puzzle of claim 39, each biasing structure comprising a leaf spring.

43. The puzzle of claim 37, at least one of the puzzle pieces having an outer surface on which either raised bands or raised crossed bands are disposed.

44. The puzzle of claim 37, each of the puzzle pieces having an outer surface on which either raised bands or raised crossed bands are disposed.

* * * * *